US006067277A

United States Patent [19]

Dinger et al.

[11] Patent Number: 6,067,277

[45] Date of Patent: May 23, 2000

[54] DIAL FORMED OF A SOLAR CELL IN PARTICULAR FOR A TIMEPIECE

[75] Inventors: Rudolf Dinger, Saint-Aubin; Jean-Paul Randin, Cortaillod; Yves Ruedin, Saint-Blaise, all of Switzerland

[73] Assignee: Asulab S.A., Bienne, Switzerland

[21] Appl. No.: 09/133,822

[22] Filed: Aug. 13, 1998

[30] Foreign Application Priority Data

Sep. 9, 1997 [CH] Switzerland ..... 2115/97

[51] Int. Cl.[7] ..... G04B 1/00; G04B 19/06; G04C 3/00

[52] U.S. Cl. ..... 368/205

[58] Field of Search ..... 368/88, 205, 228, 368/232–234

[56] References Cited

U.S. PATENT DOCUMENTS

| | | | |
|---|---|---|---|
| 3,427,797 | 2/1969 | Kimura et al. | 58/23 |
| 3,989,541 | 11/1976 | Brandhorst, Jr. | 136/89 |
| 4,666,313 | 5/1987 | Ganter et al. | 368/205 |

FOREIGN PATENT DOCUMENTS 1 380 839 1/1975 United Kingdom .

WO 96/12989 5/1996 WIPO .

OTHER PUBLICATIONS

Patent Abstracts of Japan vol. 16, No. 530 (E–1287), Oct. 30, 1992 & JP 04 199751 A (Matsushita Electric Ind. Co.), Jul. 20, 1992.

Patent Abstracts of Japan vol. 18, No. 603 (E–1632), Nov. 16, 1994 & JP 06 232435 A (Ricoh Co. LTD), Aug. 19, 1996.

Patant Abstracts of Japan vol. 96, No. 12, Dec. 26, 1996 & JP 08 204216 A (Sanyo Electric Co LTD), Aug. 9, 1996.

Patent Abstracts of Japan vol. 18, No. 8 (E–1486), Jan. 7, 1994 & JP 05 251723 A (Kanegafuchi Chem Ind Co LTD), Sept. 28, 1993.

*Primary Examiner*—Vit Miska
*Attorney, Agent, or Firm*—Griffin & Szipl, P.C.

[57] ABSTRACT

A dial, in particular for a timepiece, formed of at least one regenerating photoelectrochemical type solar cell including a first substrate intended to be exposed to the light and a second substrate carrying on their opposite faces electrodes between which is arranged a physico-chemical system capable of absorbing light and generating an electric voltage across the terminals of said electrodes, characterised in that said first substrate is formed of a translucent material.

12 Claims, 2 Drawing Sheets

DIAL FORMED OF A SOLAR CELL IN PARTICULAR FOR A TIMEPIECE

The present invention concerns a dial formed of a solar cell, in particular of the regenerating photoelectrochemical type, the dial being intended to supply a horometric circuit of a timepiece or an electric circuit of an apparatus such as a measuring apparatus or suchlike. The invention concerns more particularly a dial wherein the face shown to the user has an original aesthetic appearance such as an opalescent or metallic appearance.

Patent Document WO-A-96/12989 discloses a watch dial whose horometric circuit is supplied by a conventional solar cell. The dial described in this Patent Document is formed of a translucent ceramic sheet, such as Al2O3, arranged above the solar cell so that the latter is masked from the user's view. The translucent nature of the dial allows a sufficient quantity of luminous energy to pass to illuminate the cell situated under it.

According to this Patent Document, the solar cell and the dial which covers it are formed of two separate parts which must be independently made and mounted. This structure has numerous drawbacks. Indeed, a structure of this type increases the number of parts involved in the manufacture of a device having to be equipped therewith, such as a watch and consequently complicates the construction of such a device and increases the cost price thereof. Moreover, the superposition of the ceramic sheet and the solar cell leads to an increase in the watch's thickness. This superposed structure also leads to the creation of an interface where incidental light reflection interference is produced which is detrimental to the global efficiency of the solar cell.

A principal aim of the invention is thus to overcome these drawbacks of the aforementioned prior art by providing a dial formed of one or more solar cells integrated therein, the dial having an original opalescent or metallic appearance to the user, particularly suited to making decorative dials, for example for timepieces, while maintaining acceptable electric output for the application of the cell used as a source of energy and yet by means of a simple and economical cell structure.

The invention thus concerns, according to a first aspect, a dial, in particular for a timepiece, formed of at least one regenerating photoelectrochemical type solar cell including a first substrate intended to be exposed to the light and a second substrate carrying on their opposite faces electrodes between which is arranged a physico-chemical system capable of absorbing light and generating an electric voltage across the terminals of said electrodes, characterised in that said first substrate is formed of a translucent material.

According to a second aspect, the invention also concerns a dial, in particular for a timepiece formed of a substrate having a first face over which extends at least one plurality of superposed layers defining at least one n-i-p or p-i-n element inserted between two electrodes and a second face intended to be exposed to the light, characterised in that said substrate is formed of a translucent material.

According to a third aspect, the invention also concerns a dial, in particular for a timepiece, formed of a substrate having a first face over which extends at least one plurality of superposed layers defining at least one n-i-p or p-i-n element inserted between two electrodes and a second face intended to be exposed to the light characterised in that said substrate is formed of a transparent material and in that a layer of partially transparent and partially reflective metal is deposited on said second face of the substrate.

As a result of the features of the three aspects of this invention, a monolithic dial formed of a solar cell which fulfils the dual function of dial and electric energy source is provided, for example for a timepiece or suchlike. "Translucent material" means any material which allows part of the incident light to pass and diffuses another part thereof while masking from the user the elements situated behind the substrate made of such material. As used herein, the term "light" means, solar light on any radiations allowing the photoconversion process to occur in the cell.

According to an advantageous feature common to the first two aspects of the invention, the substrate intended to be exposed to the light has a light transmittivity, at a wavelength of 550 nm, comprised between 10% and 50% and preferably between 15% and 40%.

With such transmittivity and low lighting, for example 100 lux, the dial according to the invention can provide a current of the order of 1 $\mu$A or more, which is sufficient to supply the time-keeping circuit of an electronic timepiece.

It will also be noted that this transmittivity easily allows the use of a solar cell to be disguised, by giving the dial a much more pleasing aesthetic appearance.

According to another preferred feature common to the first two aspects of the invention, the substrate intended to be exposed to the light is made from a base of aluminium oxide, zirconium oxide or an opalescent glass.

Other features and advantages of the invention will appear more clearly upon reading the following description of embodiments of the invention given purely by way of illustrative and non limiting example, this description being made in conjunction with the drawings in which.

The description of the invention will be made within the scope of an application to a dial for a timepiece such as a watch, however it goes without saying that the invention is in no way limited to this application and that it could advantageously be used within the scope of any other application to low consumption electric instruments, in particular portable instruments, including a dial.

Figure 1:
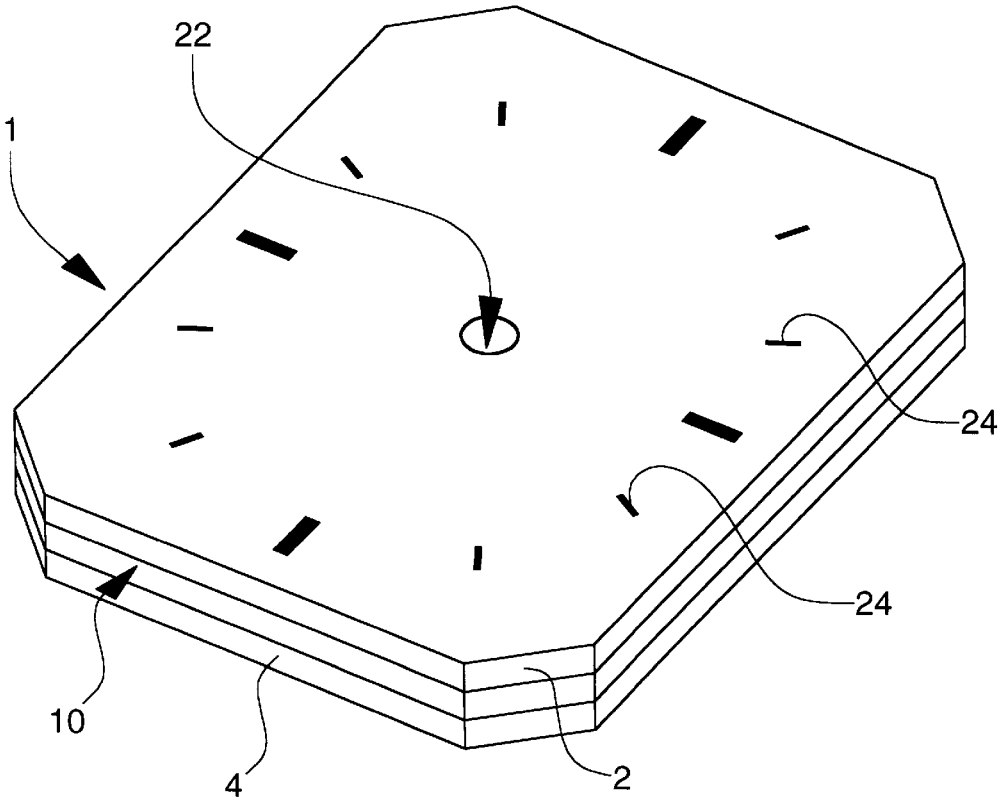
FIG. 1 is a schematic perspective drawing of a dial forming a solar cell according to a first aspect of the invention.

With reference first of all to FIG. 1, a watch dial is shown, formed of a solar cell according to a first aspect of the invention and designated by the general reference 1. Dial 1 is able to transform light rays into an electric current by a process called photoconversion to supply, via a supply circuit, a time-keeping circuit of a watch. These circuits and their connections (not shown) are well known to those skilled in the art and will consequently not be described here in more detail. For a detailed description of the photoconversion process reference should be made to pages 302 to 312 of the work entitled "Photopiles solaires" by A. Ricaud and published in "Editions Presses polytechniques et universitaires romands", ISBN 2-88074326-5.

Dial 1 according to a first aspect of the invention is formed of a regenerating photoelectrochemical type solar cell. Dial 1 includes a first substrate 2 and a second substrate 4 including respectively over the whole surface of their opposite faces an electrode 6 and 8 respectively.

A physico-chemical system 10 capable of absorbing light and generating an electric voltage across the terminals of the electrodes is arranged between the two substrates 2 and 4.

This system 10 includes a layer 12 of a semi-conductive oxide deposited on electrode 8. Layer 12 is for example formed of a layer of strongly textured titanium oxide. This system 10 further includes a mono-molecular colorant layer 14 which is adsorbed at the surface of layer 12. System 10 includes a non aqueous solvent based electrolyte 16 containing a redox pair, for example the pair iodine/iodide, this electrolyte being directly in contact with colorant layer 14. Finally, electrolyte 16 is in turn in contact with a fine layer 18 of an electrocatalyst, for example a fine layer of platinum which is deposited on electrode 6.

Substrates 2 and 4 are attached to each other, for example, by a sealing frame 20 to define a space into which system 10 is arranged.

According to the invention, one of the two substrates 2, 4 is made of a translucent material, it being understood that the substrate intended to form the visible face (or face exposed to the light) will be made of such material. In the example shown, it is substrate 2 which is intended to be exposed to the light and which is made of a translucent material.

According to the invention, the material forming substrate 2 has an incident light transmittivity comprised between 10% and 50% at a wavelength of 550 nm, which allows the desired aesthetic appearance to be obtained for the dial.

In an advantageous manner, substrate 2 can be made from a base of aluminium oxide, zirconium oxide or opalescent glass.

In order to obtain the desired transmittivity, one acts essentially on the thickness of substrate 2 taking account also, if necessary, of the grain size of the microcrystals and the degree of purity of the material used.

Substrate 2 preferably has a transmittivity comprised between 15% and 40% at a wavelength of 550 nm.

It has been noted that with a substrate 2 thickness of the order of 0.5 mm and preferably 0.3 mm, three cells connected in series having a total surface area corresponding to that of a conventional watch dial (of the order of 5 cm2), allow sufficient light to pass even in low lighting conditions (100 lux) to provide electric energy allowing a time-keeping circuit of an electronic watch to be supplied, namely typically an average current of 1 $\mu$A at a voltage of 1.5 V.

Electrode 6 carried by substrate 2 is of course formed of a conductive layer which is transparent to light at the wavelengths corresponding to the absorption of the colorant. This electrode is preferably made in the form of a thin layer of a mixture of tin and indium oxide or of antimony and tin oxide. It goes without saying that those skilled in the art could select any other equivalent transparent conductive layer.

Substrate 4 which is not a priori intended to be exposed to light rays, can be made of opaque material.

It will also be noted that all the materials used which are capable of coming into contact with electrolyte 16, in particular the two substrates 2 and 4 and electrodes 6 and 8, are materials which are chemically compatible with the electrolyte of physico-chemical system 10. "Chemically compatible" means inert materials, i.e. materials which do not react with the electrolyte, in particular with the redox pair.

Dial 1 finally includes a hole 22 situated substantially at the centre thereof to allow the passage of the shafts on which are fixed the hands of the watch to which dial 1 is intended to be fitted.

It will be noted that the drawing does not reflect the exact dimensions of the dial, these dimensions having been greatly exaggerated for purposes of clarity.

Within the scope of the application described, the substrate which is exposed to the light can also include markings 24 (FIG. 1) forming an hour-circle or other inscriptions, these markings or inscriptions being able to be added or etched on one of the two faces of the substrate in question.

Figure 2:
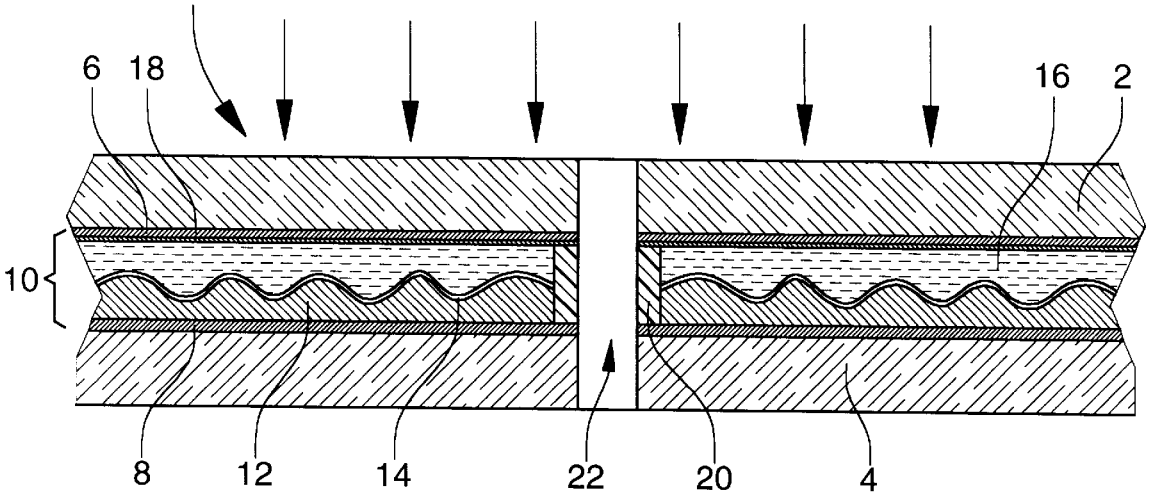
FIG. 2 is a partial longitudinal cross-section of FIG. 1.
Figure 3:
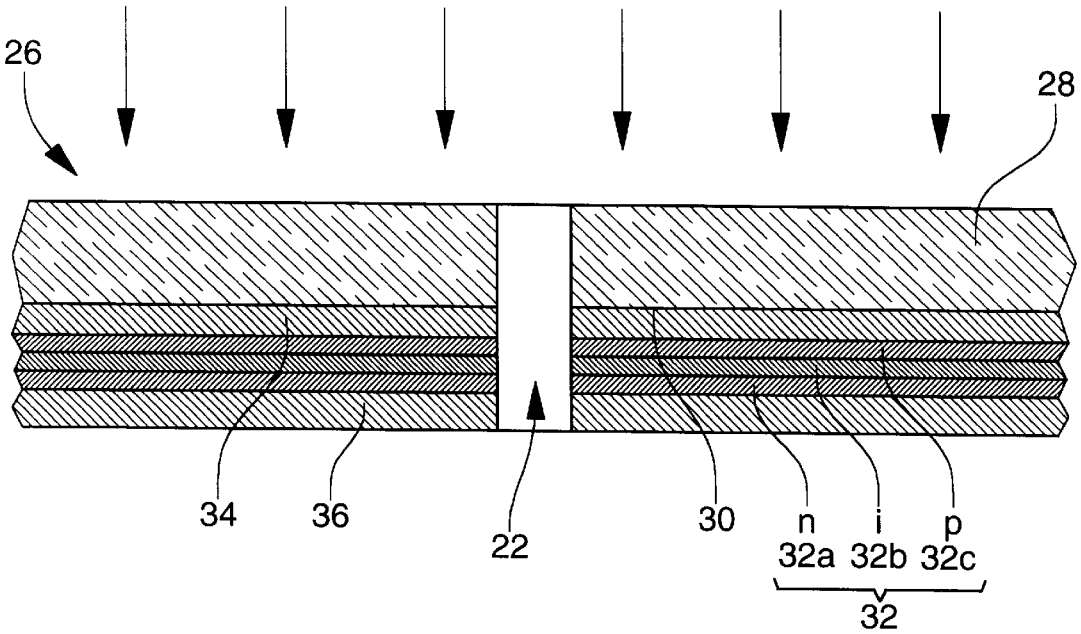
FIG. 3 is a partial longitudinal cross-section of a dial forming a solar cell according to a second aspect of the invention.

FIG. 3 shows a partial cross-section of a dial 26 according to a second aspect of the invention. Dial 26 includes a substrate 28 formed of a rigid plate having the same features as those of substrate 2 which has just been described with reference to FIGS. 1 and 2. Substrate 28 includes a first face 30 on which are deposited a plurality of thin, successive respectively p, i, n, layers 32*a*, 32*b*, 32*c* sandwiched between two conductive layers 34, 36 forming the electrodes.

Of course, electrode 34 which is arranged between layer 32*c* and in contact with the latter and substrate 28 is transparent, this electrode 34 being the element of the cell which is intended to be directly exposed to the light through substrate 28. By way of example, electrode 34 like electrode 36 can be formed by a thin layer of a mixture of antimony and tin and indium oxide (ITO).

The three layers 32*a*, 32*b* and 32*c*, forming an elementary solar cell 32, thus define a diode, i.e. a p-i-n junction diode including an intrinsic zone, inserted between a p zone and a n zone which can be exposed to light. This elementary solar cell 32 is formed of three layers of semi-conductor materials having different types of conductivity in order to constitute the p-i-n diode. Layer 32*a* of elementary cell 32 is doped for example with phosphorus to obtain an n type conductivity. The thickness of this layer is preferably of the order of 10 to 20 nm. The following layer 32*b* of elementary cell 32 is an intrinsic i layer which is thicker than the preceding one and in which a current is photo-generated when the cell is exposed to light. Layer 32*b* has for example a thickness of the order of 200 to 500 nm. Layer 32*c* of the elementary cell is for example a layer of hydrogenous amorphous silicon (a-Si:H) doped for example with boron to obtain p type conductivity.

In this example, p type layer 32*c* is the closest to substrate 28, but of course according to an alternative embodiment the closest layer to substrate 28 could be an n type layer.

Figure 4:
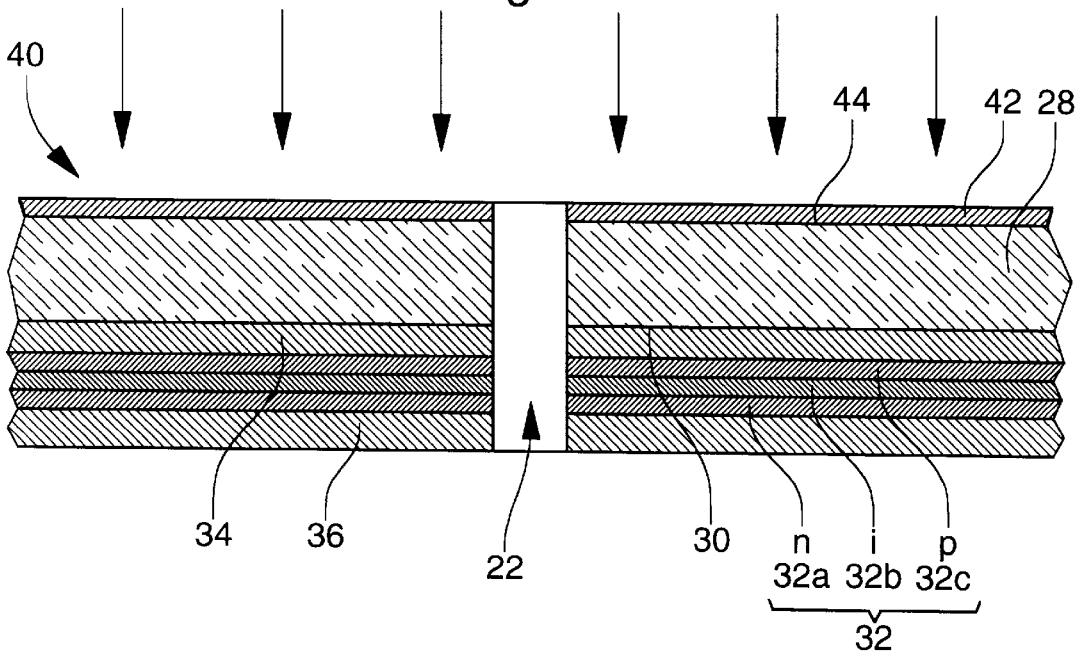
FIG. 4 is a partial longitudinal cross-section of a dial forming a solar cell according to a third aspect of the invention.

With reference now to FIG. 4 a partial cross-section of a dial 40 is shown in accordance with a third aspect of the invention, in which the same elements as those described in relation to FIG. 3 have been designated by the same numerical references.

Unlike the embodiment shown in FIG. 3, substrate 28 of dial 40 is transparent and a partially transparent and partially reflective metallic layer 42 is deposited on an external face 44 of the substrate opposite face 30.

This layer 42 has an incident light reflectivity comprised between 90% and 50% at a wavelength of 550 nm, which allows metallic brilliance and thus the desired aesthetic appearance to be obtained for the dial. In order to obtain this reflectivity, one acts essentially on the thickness of the metal of layer 42. This metallic layer 8 preferably has a reflectivity comprised between 85% and 60% at a wavelength of 550 nm.

It has also been noted that a layer 42 having a thickness of the order of 20 nm and preferably 35 nm, allows sufficient light to pass even in low lighting conditions (100 lux) for three cells connected in series having a total surface area corresponding to that of a conventional watch dial (of the order of 5 cm2), to provide electric energy allowing a time-keeping circuit of an electronic watch to be supplied, namely typically an average current of 1 $\mu$A at a voltage of 1.5 V.

Metal layer 42 can be formed of a metal selected from the group containing gold, copper, aluminium, silver, platinum, palladium, nickel, titanium and rhodium. Of course other metals having reflectivity characteristics of the same order can also be suitable.

The deposition of the metal of layer 42 can be achieved conventionally via cathodic sputtering, chemical vapour deposition or with an electron gun. This deposition can be achieved through a mask defining the contours of layer 42.

What is claimed is:

1. A dial, in particular for a timepiece, formed of at least one regenerating photoelectrochemical type solar cell including a first substrate intended to be exposed to the light and a second substrate carrying on their opposite faces electrodes between which is arranged a physico-chemical system capable of absorbing light and generating an electric voltage across the terminals of said electrodes, wherein said first substrate is formed of a translucent material.

2. A dial, in particular for a timepiece, formed of a substrate having a first face over which extends at least one plurality of superposed layers defining at least one n-i-p or p-i-n element inserted between two electrodes and a second face intended to be exposed to the light, wherein said substrate is formed of a translucent material.

3. A dial according to claim 1, wherein said substrate intended to be exposed to the light has a light transmittivity comprised between 90% and 50% at a wavelength of 550 nm and preferably between 85% and 60%.

4. A dial according to claim 1, wherein said substrate intended to be exposed to the light is made from a base of aluminium oxide, zirconium oxide or opalescent glass.

5. A dial according to claim 1, wherein said substrate intended to be exposed to the light has a thickness comprised between 0.3 and 0.5 nm.

6. A dial according to claim 2, wherein said substrate intended to be exposed to the light has a light transmittivity comprised between 90% and 50% at a wavelength of 500 nm and preferably between 85% and 60%.

7. A dial according to claim 2, wherein said substrate intended to be exposed to the light is made from a base of aluminum oxide, zirconium oxide or opalescent glass.

8. A dial according to claim 2, wherein said substrate intended to be exposed to the light has a thickness comprised between 0.3 and 0.5 nm.

9. A dial, in particular for a timepiece, formed of a substrate having a first face on which extends at least one plurality of superposed layers defining at least one n-i-p or p-i-n element inserted between two electrodes and a second face intended to be exposed to the light wherein said substrate is formed of a transparent material and wherein a layer of partially transparent and partially reflective metal is deposited on said second face of the substrate.

10. A dial according to claim 9, wherein said metal layer has a light reflectivity comprised between 90% and 50% at a wavelength of 550 nm and preferably between 855 and 60%.

11. A dial according to claim 9, wherein the metal of the metal layer is selected from the group containing gold, aluminium, silver, platinum, palladium, nickel, titanium, rhodium and copper.

12. A dial according to claim 9, wherein the metal layer has a minimum thickness comprised between 2 and 10 nm and a maximum thickness comprised between 15 and 40 nm.

* * * * *